US005102573A

United States Patent [19]

Han et al.

[11] Patent Number: 5,102,573

[45] Date of Patent: Apr. 7, 1992

[54] DETERGENT COMPOSITION

[75] Inventors: Shaw-Lin Han, East Amherst, N.Y.; Kuo-Yann Lai, Plainsboro; Edward P. Duliba, Piscataway, both of N.J.

[73] Assignee: Colgate Palmolive Co., Piscataway, N.J.

[21] Appl. No.: 527,683

[22] Filed: May 18, 1990

Related U.S. Application Data

[63] Continuation of Ser. No. 249,266, Sep. 23, 1988, abandoned, which is a continuation of Ser. No. 36,635, Apr. 10, 1987, abandoned.

[51] Int. Cl.[5] ..... C11D 7/22; C11D 7/50; B08B 7/00

[52] U.S. Cl. ..... 252/153; 252/139; 252/158; 252/170; 252/171; 252/172; 252/524; 252/529; 252/548; 252/DIG. 8; 134/38

[58] Field of Search ..... 252/139, 158, 153, 548, 252/529, 170, 171, 172, 524, DIG. 8; 134/38

[56] References Cited

U.S. PATENT DOCUMENTS

| | | | |
|---|---|---|---|
| 2,471,645 | 5/1949 | Morris et al. | 252/137 |
| 3,210,287 | 10/1965 | Kelly et al. | 252/139 |
| 3,296,147 | 1/1967 | Gatza | 252/153 |
| 3,737,386 | 5/1973 | Geiss et al. | 252/162 |
| 3,806,460 | 4/1974 | Mukai et al. | 252/111 |
| 3,808,051 | 4/1974 | Schoenholz et al. | 134/2 |
| 3,819,529 | 6/1974 | Murphy | 252/156 |
| 3,829,387 | 8/1974 | Wise et al. | 252/156 |
| 3,876,563 | 8/1975 | Collins | 252/545 |
| 3,881,948 | 5/1975 | Schoenholz et al. | 134/2 |
| 3,887,497 | 6/1975 | Ulvild | 252/526 |
| 4,056,113 | 11/1977 | Johnson et al. | 134/40 |
| 4,085,059 | 4/1978 | Smith et al. | 252/118 |
| 4,105,574 | 8/1978 | Culmone et al. | 252/154 |
| 4,116,848 | 9/1978 | Schoenholz et al. | 252/90 |
| 4,193,886 | 3/1980 | Schoenholz et al. | 252/90 |
| 4,199,482 | 4/1980 | Renaud et al. | 252/559 |
| 4,236,935 | 12/1980 | Schoenholz et al. | 134/2 |
| 4,243,559 | 1/1981 | Imamura et al. | 252/548 |
| 4,268,406 | 5/1981 | O'Brien et al. | 252/105 |
| 4,302,348 | 11/1981 | Requejo | 252/135 |
| 4,407,741 | 10/1983 | Maggi | 252/542 |
| 4,414,128 | 11/1983 | Goffinet | 252/111 |
| 4,438,009 | 3/1984 | Brusky et al. | 252/90 |
| 4,457,322 | 7/1984 | Rubin et al. | 134/2 |
| 4,465,619 | 8/1984 | Boskamp | 252/540 |
| 4,477,288 | 10/1984 | Kazmierczak et al. | 134/19 |
| 4,528,039 | 7/1985 | Rubin et al. | 134/2 |
| 4,530,780 | 7/1985 | van de Pas et al. | 252/528 |
| 4,532,067 | 7/1985 | Padron et al. | 252/174.17 |
| 4,537,638 | 8/1985 | Petersen et al. | 134/2 |
| 4,564,463 | 1/1986 | Secemski et al. | 252/174.17 |
| 4,606,840 | 8/1986 | Gaufrer et al. | 252/171 |
| 4,627,931 | 12/1986 | Malik | 252/153 |

FOREIGN PATENT DOCUMENTS 1178160 11/1984 Canada .

1275740 5/1972 United Kingdom .

OTHER PUBLICATIONS

Day et al., "Strength of Bonding of Food Soils to Dishes", *Journal of the American Oil Chemists Society 552*, 461–464 (1975).

Menger, "Interfacial Physical Organic Chemistry, Imidazole-Catalyzed Ester Hydrolysis at a Water-Heptane Boundary", *Journal of the American Chemical Society 92:20*, 5965–5971 (1970).

*Primary Examiner*—A. Lionel Clingman
*Assistant Examiner*—William S. Parks
*Attorney, Agent, or Firm*—Richard J. Angel; Richard E. Nanfeld; Robert C. Sullivan

[57] ABSTRACT

Liquid, caustic-free, pre-spotting compositions that remove baked-on food residues from hard surfaces at ambient temperatures are provided which comprise:

a. from about 1 to 40%, preferably 4 to 20%, of a surfactant selected from the group consisting of anionic surfactants, nonionic surfactants and mixtures thereof;
b. from about 1 to 10% of a builder selected from the group consisting of polyphosphates, pyrophosphates, citrates, carbonates, and mixtures thereof;
c. from about 0.2% to 2% of an amine selected from the group consisting of monoethanolamine, diethanolamine, triethanolamine and mixtures thereof;
d. water; and
e. further comprising from about 3 to 50% of a solvent, which solvent is selected from the groups consisting of:
   i) sulfolane, propylene glycol monomethyl ether acetate, dipropylene glycol monomethyl ether acetate, ethylene glycol monoethyl ether acetate, diethylene glycol monoethyl ether acetate, diethylene glycol dimethyl ether, ethylene glycol dimethyl ether, diethylene glycol diethyl ether, and mixtures thereof;
   ii) diethylene glycol monobutyl ether, ethylene glycol monobutyl ether, and N-methyl 2-pyrrolidone and mixtures thereof; and
   iii) a mixture of two solvents, the first such solvent comprising 5–17% of an acetate selected from the group consisting of ethyl acetate and n-propyl acetate, and the second such solvent comprising 15–34% of a solvent selected from the group consisting of acetone, N-methyl 2-pyrrolidone and methyl ethyl ketone, wherein the ratio of the first solvent to the second solvent may range from 1:4 to 1:2.

Additionally, such formulations may include:

f. from about 3 to 22% of imidazole; and
g. up to about 6% of a foam booster, a foam stabilizer, a viscosity adjusting agent, and mixtures thereof.

22 Claims, No Drawings

DETERGENT COMPOSITION

This application is a division, of application Ser. No. 07/249,266 filed Sept. 23, 1988 which is a continuation of Ser. No. 07/36,635 filed Apr. 10, 1987, and now abandoned.

BACKGROUND OF THE INVENTION

This invention relates to compositions in the form of liquids, sprays, gels, and pastes, which remove dried-on and cooked-on food and other difficult-to-remove soils from kitchen utensils, flatware, dishes, glassware, cookware, bakeware, cooking surfaces, and surrounding areas in a convenient, easy, timely, and mild manner.

Of the difficult-to-remove soils, the most severe is the baked and/or burned-on (especially when reheated and/or allowed to build up over time). Soil categories include grease, meat (including skin), dairy, fruit pie filling, carbohydrate, and starch. Soiled substrate categories include aluminum, iron, stainless steel, enamel, Corningware, Pyrex, and other glass cookware.

Current light duty liquid detergents are dramatically deficient in these areas. The consumer has to soak soiled items for long periods of time in these solutions, and then use harsh cleaning methods (scouring with steel wool or scouring cleanser) to remove the remaining soil.

To speed up the process and increase efficacy of cleaning these soils, the consumer will resort to heat, scraping, and harsh chemicals (e.g. caustic oven cleaners).

Deficiencies in these cleaning methods include time consumption for soaking and scouring, physical effort required for scouring and scraping, irritation to hands from harsh cleaning chemicals and methods, damage to objects from harsh chemicals and methods, unpleasant fumes and odors, and danger from heated solutions. Though non-caustic cleaners are listed in the literature, none are directed to the cleaning compositions of the present invention.

BRIEF DESCRIPTION OF THE INVENTION

The liquid pre-spotting compositions of the present invention consist of five major components. The first three (the ternary system) include surfactants (nonionic, anionic and their combinations), builder salts, and an amine. The fourth component is water, and the fifth is a solvent system by which the efficacy of the ternary system is enhanced. Such solvent system utilizes specific individual organic solvents or certain binary solvent systems comprising mixtures of at least two organic solvents. These compositions may be formulated as clear, single-phase liquids, sprays, gels, or pastes and dispensed from bottles, pump sprays, aerosol cans, squeeze bottles, or paste dispensers. It has been found that applying the caustic-free compositions of the present invention to soiled surfaces removes the above mentioned soils at ambient temperature in a relatively short period of time (from 10 to 30 minutes) without need for heat, long soaking times, scouring, or harsh chemicals.

Formulations according to the present invention comprise:

a. from about 1 to 40%, and preferably 4 to 20%, of a surfactant selected from the group consisting of anionic surfactants, nonionic surfactants and mixtures thereof;

b. up to about 10% of a builder selected from the group consisting of polyphosphates, pyrophosphates, citrates, and carbonates;

c. up to about 2% of an amine selected from the group consisting of monoethanolamine, diethanolamine and triethanolamine;

d. water; and e. further comprising from about 3 to 50% of a solvent, which solvent is selected from the groups consisting of:

i) sulfolane, propylene glycol monomethyl ether acetate, dipropylene glycol monomethyl ether acetate, ethylene glycol monoethyl ether acetate, diethylene glycol monoethyl ether acetate, diethylene glycol dimethyl ether, ethylene glycol dimethyl ether, diethylene glycol diethyl ether, and mixtures thereof;

ii) diethylene glycol monobutyl ether, ethylene glycol monobutyl ether, and N-methyl 2-pyrrolidone; and iii) a mixture of two solvents, the first such solvent comprising 5–17% of an acetate selected from the group consisting of ethyl acetate and n-propyl acetate, and the second such solvent comprising 15–34% of a solvent selected from the group consisting of acetone, N-methyl 2-pyrrolidone and methyl ethyl ketone, wherein the ratio of the first solvent to the second solvent may range from 1:4 to 1:2.

Additionally, such formulations may include:

f. up to about 22% imidazole; and g. up to about 6% of a foam booster, a foam stabilizer, and a viscosity adjusting agent.

It has now been found that the problem of removing cooked-on and dried-on food residues from utensils, dishes, etc., can be resolved by applying thereto for a relatively short time (10–30 minutes) the prespotting composition of the present invention.

In accordance with the invention, the removal of cooked-on soils is thus effected by: contacting such soiled dishes, bakeware, or utensils with an effective amount of the above-idenified pre-spotting compositions; allowing an effective amount of time (at least about 10 minutes) for the composition to soak through the soil; and then rinsing the affected soiled surfaces to remove the pre-spotting composition and the loosened soil.

KEY TO INGREDIENTS HEREIN

AEOS—Alcohol ethoxylate sulfate

Butoxydiglycol (CTFA name)—Diethylene glycol monobutyl ether—Butyl Carbitol—Union Carbide.

Butoxyethanol (CTFA name)—Ethylene glycol monobutyl ether—Butyl Cellosolve—Union Carbide.

$C_{14}$ TAB—Myristyl trimethyl ammonium bromide

Cocamide DEA (CTFA name)—Coconut diethanolamide—Monoamid 150 ADD —Mona

Cocoamidopropyl Betaine—Surco Coco Betaine—Oxyx

DEA—Diethanolamine

EDTA—Ethylene diamine tetra acetic acid, sodium salt

Lauric/Myristic Diethanolamide—The fatty acid of the amide is a mixture of lauric and myristic acids, usually in a proportion of 1:3 to 3:1 and preferably about 1:1. Thus, such material is really a mixture of two different diethanolamides but is generally named for convenience as lauric/myristic diethanolamide or LMDEA.

LDBS—Sodium linear dodecyl benzene sulfonate (55% A.I.)

MEA—Monoethanolamine

NMP—N-methyl 2-pyrrolidone

Pareth 25-9 (CTFA name)—Polyethylene glycol ether mixture of synthetic $C_{12-15}$ fatty alcohols with any average of 9 moles of ethylene oxide—Neodol 25-9 (Shell)

Sodium Lauroyl Sarcosinate (CTFA name)—Hamposyl L-30—W. R. Grace (30% A.I)

Sodium Pareth-25 Sulfate (CTFA name)—Sodium salt of a sulfated polyethylene glycol ether of a mixture of synthetic $C_{12-15}$ fatty alcohols—Neodol 25-3S (Shell)

Sulfolane—Tetramethyl sulfone; tetrahydrothiophene-1,1-dioxide

TEA—Triethanolamine

TKPP—Tetrapotassium pyrophosphate

DETAILED DESCRIPTION OF THE INVENTION

The pre-spotting compositions of this invention are essentially comprised of the following components: surfactant, builder, alkanolamine, solvent system, and water. In addition to the above ingredients, the compositions of this invention may contain other substances generally present in detergent compositions. For example, the composition may be thickened if desired by the addition of known viscosity increasing, thixotropic, or viscoelastic agents. Foam stabilizing agents may also be incorporated, and other ingredients which may normally be present include preservatives, humectants, foam boosters, anti-foaming agents, dispersants, pH modifiers, colorants, and perfumes. There may also be present, if desired, imidazole.

According to a first embodiment of the invention, the surfactant, which is present in the amount of 1–10% of the composition, is selected from the group consisting of nonionic surfactants, anionic surfactants, and their combinations. Preferably, the surfactant is present in the amount of 1–5%.

The nonionic surfactant, preferably, is comprised of one or a mixture of primary alcohol ethoxylates or secondary alcohol ethoxylates or alkyl phenol ethoxylates. The primary alcohol ethoxylates are represented by the general formula:

$$R—O—(CH_2—CH_2—O)_n—H$$

wherein R is an alkyl radical having from 9 to 16 carbon atoms and the number of ethoxylate groups, n, is from 5 to 12. Commercially available nonionic surfactants of this type are sold by Shell Chemical Company under the tradename Neodol and by Union Carbide Corporation under the tradename Tergitol.

The secondary alcohol ethoxylates are represented by the general formula:

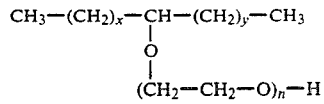

Wherein x+y is from 6 to 15 and the number of ethoxylate groups, n, is from 5 to 12. Commercially available surfactants of this type are sold by Union Carbide Corporation under the tradename Tergitol S series surfactants, with Tergitol 15-S-9 (T 15-S-9) being preferred for use herein.

The alkyl phenyl ethoxylates are represented by the general formula:

$$R—(phenyl)—O—(CH_2—CH_2—O)_n—H$$

where the number of ethoxylate groups, n, is from 8 to 15, and R is an alkyl radical having 8 or 9 carbon atoms. Commercially available nonionic surfactants of this type are sold by Rohm and Haas Company under the tradenames Triton N and Triton X series.

The anionic surfactant is preferably comprised of paraffin sulfonates, sodium alkyl sulfates, and alkyl benzene sulfonates, such as sodium linear tridecyl or dodecyl benzene sulfonate, sodium and/or ammonium alcohol 3-ethoxy sulfate (AEOS), sodium lauroyl, cocoyl or myristoyl sarcosinate or a combination thereof.

The surfactant in the ternary system can be anionic, nonionic, or a combination thereof, as shown below:

| Test Liquid | Soil Substrate | egg glass | milk-egg glass | milk-egg Al | milk-egg SS |
|---|---|---|---|---|---|
| T 15-S-9/TKPP/TEA (1%/1%/0.2%) | | SR = 88% | 100% | 100% | 97% |
| Pareth 25-9/TKPP/TEA (1%/1%/0.2%) | | 70% | 90% | 90% | 94% |
| LDBS/AEOS/TKPP/TEA (0.575%/0.425%/1%/0.2%) | | 100% | 100% | 94% | 100% |
| COMMERCIAL (LDLD) #1 | | 30% | 15% | 18% | 19% |
| COMMERCIAL (LDLD) #2 | | 47% | 20% | 18% | 22% |

It has been found, however, that cationic surfactants adversely effect the soil removal efficiency of the ternary system, as shown below:

| | Milk-Egg/Glass | Egg/Glass |
|---|---|---|
| T 15-S-9/TKPP/TEA (1/1/0.2) | 78% | 100% |
| T 15-S-9/TKPP/TEA/$C_{14}$TAB (1/1/0.2/0.5) | 5% | 15% |

The composition also contains up to 10% of a builder salt or electrolyte, which is comprised of phosphates, such as tetrapotassium pyrophosphate, sodium tripolyphosphate; carbonates, such as sodium carbonate, sodium sesquicarbonate and sodium bicarbonate; citrates, such as sodium citrate; and sodium ethylene diamine tetra acetate. The preferred amount of the builder in the composition is 1%.

Up to about 2% of an amine is also present. This amine comprises an alkanolamine, namely monoethanolamine, diethanolamine or triethanolamine. About 0.2% of the alkanolamine in the composition is preferred.

The solvent comprises about 15–50% of the composition, the solvent being binary in nature. The first solvent comprises about 5–17% of an acetate selected from the group consisting of ethyl acetate and n-propyl acetate. The second solvent comprises about 15–34% of acetate, N-methyl, 2-pyrrolidone and methyl ethyl ketone.

The ratio of the first solvent to the second solvent may range from 1:4 to 1:2.

Water completes the balance of the composition, the pH of which is about 9.

The pre-spotting compositions of the first embodiment of the present invention will now be illustrated by the following examples, wherein all parts and percentages are by weight and all temperatures in degrees Celsius unless otherwise indicated.

| Composition | #1 | #2 | #3 | #4 | #5 | #6 |
|---|---|---|---|---|---|---|
| Tergitol 15-S-9 | 1% | 1% | 1% | 1% | | |
| Sodium Linear Dodecyl Benzene Sulfonate | — | — | — | — | 0.575% | 0.575% |
| Ammonium Alcohol 3EO Ethoxysulfate | — | — | — | — | 0.425% | 0.425% |
| Tetrapotassium Pyrophosphate | 1% | 1% | 1% | 1% | 1% | 1% |
| Triethanolamine | 0.2% | 0.2% | 0.2% | — | 0.2% | — |
| Ethyl Acetate | — | 16.7% | 7.5% | 7.5% | 7.5% | 7.5% |
| Acetone | — | 33.3% | 22.5% | 22.5% | 22.5% | 22.5% |
| Water and minor ingredients | | | BALANCE | | | |
| pH | 9 | 9 | 9 | 9 | 9 | 9 |

The foregoing formulations at use concentration were then applied to soiled substrates which were prepared and tested as follows:

Soil/Substrate Preparation

Three types of substrates were used in the experiments:

1. Precleaned glass microslides (25×75 mm) [products of Sargent-Welch].
2. Stainless steel planchets (2" diameter) [products of Interox Co].
3. Aluminum coupons (25×75 mm) were made by a machine shop.

Model food soils included milk, milk-egg mixture, egg, flour-egg mixture and Crisco shortening. They were applied uniformly onto the substrates.

The baking conditions for various soils are shown in Table I.

TABLE I

| Baking Condition | Soil Substrate | Milk-Egg Glass | Crisco-Shortening Aluminum | Crisco Shortening Stainless Steel |
|---|---|---|---|---|
| Temperature (degree Celsius) | | 195 | 195 | 190 |
| Time | | 30 min | 1 hr 50 min | 1 hr 45 min |

Soiled substrates were then soaked in the test formulations and 3% (by weight) commercial LDLD's at 45 degrees Celsius for various length of time depending on the soil-substrate. The results are shown in Table II.

Soaking and Soil Removing

Soiled substrates were soaked in the test detergent solutions for various amounts of time at either ambient temperature or 45 degrees Celsius depending on the soil/substrate combinations. The loosened soils were removed by either handwiping with a wet sponge or machine wiping with a sponge attached to a Gardener Abrasion Tester.

Soil removal efficiency (SR) is determined by the percentage of soils removed:

$$\% SR = \frac{\text{the weight of the soil removed}}{\text{total soil weight}}$$

Due to variations of experimental conditions, SR indicates only relative preformance among the test solutions carried out in the same experiment, not an absolute value.

TABLE II

| Product | % SOIL REMOVAL soil substrate | milk-egg glass | Crisco-shortening Aluminum | Crisco shortening Stainless Steel |
|---|---|---|---|---|
| Example #1 | | 73% | 7% | 0% |
| Example #2 | | 90% | 85% | 95% |
| Example #3 | | 89% | 56% | 92% |
| Example #4 | | 92% | 83% | 88% |
| Example #5 | | 65% | 87% | 92% |
| Example #6 | | 79% | 42% | 91% |
| Commercial LDLD #1 | | 21% | 4% | 0% |
| Commercial LDLD #2 | | 22% | 7% | 2% |

As is evident from the foregoing examples, the solvent-containing detergents (Example A, #2–#6) are more efficacious than a solvent-free ternary component system (Example A, #1). The improvement is particularly dramatic for the baked-on grease removal. Two factors—the total solvent content and ethyl acetate: acetone ratio—are critical for determining the soil removal efficiency. Higher ethyl acetate: acetone ratio and higher total solvent concentration are strongly preferred.

These compositions may be prepared as follows:

The builder salt (i.e. potassium pyrophosphate) and the alkanolamine (i.e. triethanolamine) are dissolved in the softened water with moderate stirring. The surfactant(s) and solvents are then added with slow stirring until dissolved. The pH of the solution is adjusted to 9 with sulfuric acid. Perfume, if used, is added last.

While the foregoing compositions give positive results, the low flash points of several of the solvents (ethyl acetate—30 degrees Fahrenheit and acetone—0 degrees Fahrenheit) make it preferable to utilize solvents of higher boiling points. This leads to the second embodiment of the present invention.

Solvents of higher flash point that have been found to provide pre-spotting action to remove cooked-on food residues from utensils and bakeware with the other ingredients of this invention include: sulfolane, propylene glycol monoethyl ether acetate and diethylene glycol dimethyl ether. Their flash points are 350 degrees Fahrenheit, 116 degrees Fahrenheit, and 153 degrees Fahrenheit respectively. Moreover, propylene glycol monomethyl ether acetate can be replaced by dipropylene glycol monomethyl ether acetate, ethylene glycol monoethyl ether acetate or diethylene glycol monoethyl ether acetate: and diethylene glycol dimethyl ether can be replaced by ethylene glycol dimethyl ether or diethylene glycol diethyl ether.

Compositions according to this embodiment of the invention comprise surfactant (1-5%), builder (1%), alkanolamine (up to 0.2%), water, and the solvents identified above—either singly or in a combination of two, so long as the total solvent content is between 15-50% of the composition, the pH of which is about 9.

The pre-spotting compositions of the second embodiment of the present invention will now be illustrated by the following examples, wherein all parts and percentages are by weight and all temperatures are in degrees Celsius unless otherwise indicated.

TABLE III

| Baking Condition | Soil Substrate | Milk-egg glass | Egg glass | Crisco Shortening stainless steel | Crisco Shortening Aluminum |
|---|---|---|---|---|---|
| Temperature | | 190 | 190 | 190 | 190 |
| Time | | 20 min | 30 min | 1½ hours | 1½ hours |

Cleaning Test

The soaking and cleaning procedures are similar to those described above, e.g., glass slides, aluminum coupons and stainless steel planchets were employed as substrates. Three types of soils—Milk-egg, egg, and Crisco shortening—were uniformly applied onto the substrates. The baking conditions for various solids are shown in Table III.

| COMPOSITION | #1 | #2 | #3 | #4 | #5 | #6 |
|---|---|---|---|---|---|---|
| Sodium Linear Dodecyl Benzene Sulfonate | 0.57% | 0.57% | 0.57% | 0.57% | 0.57% | 0.57% |
| Ammonium Alcohol 3EO Ethoxysulfate | 0.42% | 0.42% | 0.42% | 0.42% | 0.42% | 0.42% |
| Tetrapotassium Pyrophosphate | 1% | 1% | 1% | 1% | 1% | 1% |
| Triethanolamine | 0.2% | 0.2% | 0.2% | 0.2% | 0.2% | 0.2% |
| Sulfolane | — | 15% | — | — | 15% | 15% |
| Propylene glycol monomethyl ether acetate | — | — | 15% | — | 15% | — |
| Diethylene glycol dimethyl ether | — | — | — | 15% | — | 15% |
| Water and Minor ingredients | | | BALANCE | | | |
| pH | 9 | 9 | 9 | 9 | 9 | 9 |

Soiled substrates were then soaked in the test formulations as is and commercial LDLD's were diluted to 3% concentration at 45 degrees Celsius for an hour. The results are shown in Table IV.

TABLE IV

| Test liquid | Soil Substrate | % SOIL REMOVAL Milk-egg Glass | Egg Glass | Crisco Shortening Stainless Steel | Crisco Shortening Aluminum |
|---|---|---|---|---|---|
| Example #1 | | 86% | 28% | 7% | 11% |
| Example #2 | | 79% | 90% | 50% | 30% |
| Example #3 | | 28% | 50% | 92% | 85% |
| Example #4 | | 95% | 30% | 37% | 51% |
| Example #5 | | 41% | 74% | 97% | 35% |
| Example #6 | | 81% | 81% | 91% | 66% |
| Commercial LDLD #1 | | 29% | 15% | 0% | 7% |
| Commercial LDLD #2 | | 17% | 15% | 2% | 10% |

The superiority of the compositions of this invention (Examples #2-#6) over the non-solvent composition (Example #1) and the commercial LDLD's is thus clearly demonstrated. These systems are more efficacious than their respective non-solvent containing counterpart. The improvement is particularly noticeable for baked-on grease removal.

The compositions of the third embodiment of this invention comprise water, solvent, the ternary system, and imidazole.

As reported in the literature (U.S. Pat. Nos. 3,819,529; 4,477,288; and 4,537,638) imidazole was found to remove certain organic matter. However, in U.S. Pat. No. 3,819,529 an alkyl or aryl (up to $C_6$) substituted imidazole-containing composition was found effective as a paint stripping composition. In U.S. Pat. No. 4,477,288, imidazole and alkyl or aryl substituted imidazoles were found useful in removing soil on ovens, baking pans, and barbecue racks, and finishes, coatings, paint and the like, when combined with a glycol phenyl ether. However, to be effective, the composition is applied in dry form and then heated to a temperature at which the composition is rendered liquid or the organic matter containing surface is first heated to a temperature above the melting point of the composition and then the composition is applied thereto, or when applied at room temperature to a soiled substrate and allowed to remain on. In U.S. Pat. No. 4,537,638, a composition that removes organic matter is also disclosed which includes an imidazole or an alkyl or aryl substituted imidazole, which, when applied to baked-on food residues, required applying the composition to the soiled surface and then heating same or applying the composition to a pre-heated soiled surface or applying the composition and leaving it on the soiled surface for 16 hours.

It has been found that when imidazole is combined with the ternary system of the present invention, and an organic solvent, a synergistic effect occurs, i.e., the soil removal of the combination is greater than either system alone. Such enhancement is particularly noticeable for baked-on grease. These compositions are effective at a pH of 10. Imidazole can be present in the amount of 3–22%. The effect of varying the concentration of imidazole is shown below:

EXAMPLE C

| Compositions | #1 | #2 | #3 | #4 |
|---|---|---|---|---|
| Imidazole | 1.0% | 2.0% | 3.0% | 4.0% |
| LDBS | 4.0% | 4.0% | 4.0% | 4.0% |
| TKPP | 6.0% | 6.0% | 6.0% | 6.0% |
| TEA | 0.75% | 0.75% | 0.75% | 0.75% |
| LMDEA | 2.0% | 2.0% | 2.0% | 2.0% |
| AEOS | 3.0% | 3.0% | 3.0% | 3.0% |
| Butoxyethanol | 4.0% | 4.0% | 4.0% | 4.0% |
| DI Water | 79.25% | 78.25% | 77.25% | 76.25% |
| pH | | | 10 | |

TABLE V

| Test Liquid | % SOIL REMOVAL soil substrate | Crisco Aluminum |
|---|---|---|
| Example #1 | | 23% |
| Example #2 | | 35% |
| Example #3 | | 43% |
| Example #4 | | 53% |
| tap water | | 2% |
| Commercial LDLD | | 18% |

The compositions of the third embodiment of this invention can be summarized as follows:

A. 3% to 22% imidazole;

B. 3% to 20% solvent, which can be Butyl Cellosolve, Butyl Carbitol, or N-methyl 2-pyrrolidone.

C. 0.5% to 2% of either triethanolamine, monoethanolamine, or diethanolamine.

D. 2% to 7% of tetrapotassium pyrophosphate or other builder such as sodium or potassium carbonate, sodium sesquicarbonate, sodium citrate sodium tripolyphosphate, or sodium bicarbonate.

E. 3% to 20% of a surfactant, such as sodium linear tridecyl or dodecyl benzene sulfonate, sodium alcohol 3-ethoxy sulfate, sodium lauroyl, cocoyl, or myristoyl sarcosinate, or a combination thereof.

F. up to 6% foam booster, a foam stabilizer, and a viscosity adjusting agent such as cocomonoethanolamide, lauryl/myristyl monoethanolamide, coco betaine, lauryl/myristyl diethanolamide, sodium polyacrylate or polyacrylic acid.

G. water.

The final solution is adjusted with sulfuric acid to a pH of 10.00.

Representative compositions of the third embodiment of this invention are as follows:

EXAMPLE D

| Composition | #1 | #2 | #3 | #4 | #5 | #6 |
|---|---|---|---|---|---|---|
| Sodium Lauroyl Sarcosinate | — | — | 16.7% | 10% | — | 16.7% |
| Cocoamidopropyl Betaine | 6% | 6% | — | — | — | — |
| Cocoamide DEA | — | — | — | 6% | — | — |
| Imidazole | 5% | 5% | 5% | — | 5% | 5% |
| TKPP | 6% | 6% | 6% | 6% | 2% | 6% |
| Butoxydiglycol | 4% | — | — | — | — | — |
| Butoxyethanol | — | — | — | 4% | 4% | 4% |
| N-Methyl 2-Pyrrolidone | — | 4% | 4% | — | — | — |
| TEA | 1% | 1% | 1.2% | 1% | 1% | 1.2% |
| Sodium Pareth-25 Sulfate | — | — | — | — | 3% | — |
| LDBS | 4% | 4% | — | — | 4% | — |
| Sodium EDTA | — | — | — | — | 1% | — |
| Water (deionized) | 74% | 74% | 67.1% | 73% | 80% | 67.1% |
| pH | 10 | 10 | 10 | 10 | 10 | 10 |

The test compositions were evaluated on three soils.

1. Egg yolk was brushed onto 2" diameter aluminum planchets and dried for two hours at 80 degrees Celsius.
2. A solution of 10% mild cheddar cheese was dissolved in warm milk. The solution was baked onto 2" diameter Pyrex Petri dishes at 175 degrees Celsius for 25 min.
3. Crisco was baked onto 2" diameter aluminum planchets for 3 hours at 175 degrees Celsius.

The test liquid was applied neat to the soiled area for 30 min. at room temperature. The test soils were then inverted and rinsed in standing water with vigorous agitation for 10 seconds. Percent soil removal was determined by averaging the visual estimates of soil removal from three replicates. The results are shown in Table VI.

TABLE VI

| Test Liquid | % SOIL REMOVAL soil substrate | egg/yolk aluminum | cheese/milk pyrex | Crisco aluminum |
|---|---|---|---|---|
| Example #2 | | 88% | 76% | 75% |
| Commercial LDLD | | 17% | 0% | 12% |
| tap water | | 27% | 3% | 2% |
| Example #1 | | 78% | 70% | 60% |
| Example #4 | | 93% | 43% | 28% |
| Commercial | | 35% | 1% | 20% |

TABLE VI-continued

| Test Liquid | % SOIL REMOVAL soil substrate | egg/yolk aluminum | cheese/milk pyrex | Crisco aluminum |
|---|---|---|---|---|
| LDLD | | | | |
| tap water | | 7% | 0% | 10% |
| Example #5 | | 97% | 80% | 13% |
| Commercial | | 30% | 0% | 22% |
| LDLD | | | | |
| tap water | | 8% | 2% | 0% |
| Example #3 | | 96% | 91% | 47% |
| Example #6 | | 95% | 95% | 20% |
| Commercial | | 30% | 0% | 22% |
| LDLD | | | | |
| tap water | | 8% | 0% | 17% |

The compositions of this embodiment of the invention at a pH of 10.00 were found to be equivalent in performance to commercial products of higher pH and superior when those commercial products were adjusted to a pH of 10.00. Moreover, these compositions are the fastest acting of the three embodiments disclosed herein, effective about ten (10) minutes after application to the soiled surface.

As previously indicated, the compositions of the present invention are preferably formulated as clear, single phase liquids. However, it is within the ambit of this invention to formulate these compositions as gels, pastes, and aerosols, and they may be dispensed from both pump sprayers and aerosol cans or brushed on. Preparation of compositions suitable to be dispensed by aerosol or pump spray is within the ordinary skill in the art.

When it is desired to use a thickening, thixotropic, or pseudo-plastic agent with the compositions of the invention, for example when the organic matter to be removed is on a non-horizontal surface and it is desirable to maintain contact between these compositions and the soiled surface, any such agent, or mixture of two or more thereof, which is compatible with the ingredients of these formulations may be used. Useful organic thickening agents include starch, sodium carboxymethylcellulose, hydroxyethyl cellulose, methocel, and water-soluble polymers such as carboxy vinyl polymer (Carbopols—B.F. Goodrich Chemical Company), sodium polyacrylate, and polyacrylic acid. Thixotropic agents include inorganic colloidal materials [clays] including Veegum (magnesium aluminum silicate—R. T. Vanderbilt). Pseudo-plastic or viscoelastic materials include the organic gums such as xanthan gum (Keltrol—Kelco Company), guar gum, and locust bean gum. When used, the thickening agent will typically vary between 0.1 to 6% by weight of the composition. Generally, it is desired to maintain the viscosity of these formulations between 100 and 1000 cps. If the viscosity is too low, the compositions do not adhere well to the soiled surfaces. If too high, it has been found that the efficacy of these compositions is diminished.

Suitable foam boosters and foam stabilizers include cocomonoethanolamide, lauryl/myristyl monoethanolamide, cocobetaine, and lauryl/myristyl diethanolamide.

These compositions may be prepared in the manner previously described for preparing the compositions of the first embodiment of the invention.

A preferred composition according to the third embodiment of the invention can be prepared by mixing:

4% Linear dodecyl benzene sulfonate
3% Sodium $C_{12-15}$ Alcohol 3-Ethoxy Sulfate
4% Butyl Cellosolve
0.75% Triethanolamine
6% Tetrapotassium pyrophosphate
5% Imidazole
1% Lauric/myristic diethanolamide
0.05% Xanthan gum
1.0% Glycerin
1.0% Colloidal magnesium aluminum silicate [Veegum PRO]
73.8% Water
0.4% Perfume
pH adjusted to 10.0

The clay (colloidal magnesium aluminum silicate) is added with high shear to the softened water and stirred for 30 minutes. The xanthan gum is dispersed in the glycerin. This mixture is then added with high shear to the batch and stirred for 30 minutes. The imidazole, potassium pyrophosphate, and triethanolamine are added with moderate stirring until dissolved. The lauric/myristic diethanolamide is dissolved in the alcohol ethoxysulfate. This solution, sodium linear dodecyl benzene sulfonate, and butyl cellosolve are added to the batch with slow stirring until dissolved. The pH of the batch is adjusted to 10.0 with sulfuric acid. The batch is completed with the addition of the perfume.

The foregoing detailed description of the invention is given by way of illustration only. Thus, variations may be made therein without departing from the scope and spirit of the invention.

What is claimed is:

1. A method for treating hard surfaces soiled with cooked-on, baked-on or dried-on food residues comprising:

applying to such soiled surface a pre-spotting composition which comprises a. from about 1 to 40% of a surfactant selected from the group consisting of anionic surfactants, nonionic surfactants and mixtures thereof;

b. from about 1 to 10% of a builder selected from the group consisting of polyphosphates, citrates, pyrophosphates, carbonates and mixtures thereof;

c. from about 0.2 to 2% of an amine selected from the group consisting of monoethanolamine, diethanolamine, and triethanolamine and mixtures thereof;

d. water; and e. from about 3 to 50% of a solvent, which solvent is selected from the groups consisting of:

i) sulfolane, propylene glycol monomethyl ether acetate, dipropylene glycol monomethyl ether acetate, ethylene glycol monoethyl ether acetate, diethylene glycol dimethyl ether, ethylene glycol dimethyl ether, diethylene glycol diethyl ether, and mixtures thereof;

ii) Diethylene glycol monobutyl ether, ethylene glycol monobutyl ether, and N-methyl 2-pyrrolidone and mixtures thereof; and iii) a mixture of two solvents, the first such solvent comprising 5–17% of an acetate selected from the group consisting of ethyl acetate and n-propyl acetate, and the second such solvent comprising 15–34% of a solvent selected from the group consisting of acetone, N-methyl 2-pyrrolidone and methyl ethyl ketone, wherein the ratio of the first solvent to the second solvent may range from 1:4 to 1:2;

and maintaining said so applied soiled surface at a temperature ranging from room temperature to 45° C. for a period of time ranging from at least about ten to thirty minutes to permit said composition to loosen said residues and then rinsing said surface to remove said loosened residue.

2. The method of claim 1 wherein the composition further includes from about 3 to 22% of imidazole.

3. The method of claim 2 wherein the composition further includes up to about 6% of a foam booster, a foam stabilizer, a viscosity adjusting agent, and mixtures thereof.

4. The method of claim 3 wherein the viscosity adjusting agent is selected from the group consisting of thickening agents, thixotropic agents, viscoelastic or pseudo-plastic agents and mixtures thereof.

5. The method of claim 1 wherein the anionic surfactant is selected from the group consisting of paraffin sulfonates, sodium alkyl sulfates, alkyl benzene sulfonates, alcohol ethoxy sulfates, sodium lauroyl sarcosinate, sodium cocoyl sarcosinate, sodium myristoyl sarcosinate and combinations thereof.

6. The method of claim 1 wherein the nonionic surfactant is selected from the group consisting of primary alcohol ethoxylates, nonylphenol alcohol ethoxylates, secondary alcohol ethoxylates, alkyl phenol ethoxylates, and mixtures thereof.

7. The method of claim 1 wherein the phosphate is selected from the group consisting of tetrapotassium pyrophosphate, sodium tripolyphosphate and mixtures thereof.

8. The method of claim 1 wherein the carbonate is selected from the group consisting of sodium carbonate, sodium sesquicarbonate, sodium bicarbonate, and mixtures thereof.

9. The method of claim 4 wherein the viscosity adjusting agent is a thickening agent is selected from the group consisting of starch, sodium carboxymethylcellulose, hydroxyethyl cellulose, methocel, and water soluble polymers.

10. The method of claim 9 wherein the water-soluble polymer is selected from the group consisting of carboxyvinyl polymers, sodium polyacrylate and polyacrylic acid.

11. The method of claim 4 wherein the viscosity adjusting agent is a thixotropic agent comprising an inorganic colloidal material.

12. The method of claim 11 wherein the inorganic colloidal material comprises a clay or magnesium aluminum silicate.

13. The method of claim 4 wherein the viscosity adjusting agent is a pseudo-plastic material comprising an organic gum.

14. The method of claim 13 wherein the organic gum is selected from the group consisting of xanthan gum, guar gum and locust bean gum.

15. The method of claim 9 wherein the viscosity ranges from 100 to 1000 cps.

16. The method of claim 3 wherein the foam booster and foam stabilizer are selected from the group consisting of cocomonoethanolamide, lauryl/myristyl monoethanolamide, cocobetaine and lauryl/myristyl diethanolamide.

17. A method for treating hard surfaces soiled with cooked-on, baked-on or dried-on food residues comprising:

applying to such soiled surface a pre-spotting composition which comprises a. from about 1 to 10% of a surfactant selected from the group consisting of anionic surfactants, nonionic surfactants and mixtures thereof;

b. from about 1 to 10% of a builder selected from the group consisting of polyphosphates, citrates, pyrophosphates, carbonates and mixtures thereof;

c. from about 0.2 to 2% of an amine selected from the group consisting of monoethanolamine, diethanolamine, and triethanolamine and mixtures thereof;

d. from about 3 to 50% of a solvent, which solvent is selected from the groups consisting of a mixture of two solvents, the first such solvent comprising 5–17% of an acetate selected from the group consisting of ethyl acetate and n-propyl acetate, and the second such solvent comprising 15–34% of a solvent selected from the group consisting of acetone, N-methyl 2-pyrrolidone and methyl ethyl ketone, wherein the ratio of the first solvent to the second solvent may range from 1:4 to 1:3; and e. water;

and maintaining said so applied soiled surface at a temperature ranging from room temperature to 45° C. for a period of time ranging from at least about ten to thirty minutes to permit said composition to loosen said residues and then rinsing said surface to remove said loosened residue.

18. The method of claim 17 wherein the pH of said composition is 9.

19. A method for treating hard surfaces soiled with coated-on, baked-on or dried-on food residues comprising:

applying to such soiled surface a pre-spotting composition which comprises a. from about 1 to 5% of a surfactant selected from the group consisting of anionic surfactants, nonionic surfactants and mixtures thereof;

b. about 1% of a builder selected from the group consisting of polyphosphates, citrates, pyrophosphates, carbonates and mixtures thereof;

c. about 0.2% of an amine selected from the group consisting of monoethanolamine, diethanolamine, and triethanolamine and mixtures thereof;

d. from about 3 to 50% of a solvent, which solvent is selected from the groups consisting of sulfolane, propylene glycol monomethyl ether acetate, dipropylene glycol monomethyl ether acetate, ethylene glycol monoethyl ether acetate, diethylene glycol monoethyl ether acetate, diethylene glycol dimethyl ether, ethylene glycol dimethyl ether, diethylene glycol diethyl ether, and mixtures thereof; and e. water;

and maintaining said so applied soiled surface at a temperature ranging from room temperature to 45° C. for a period of time ranging from at least ten to thirty minutes to permit said composition to loosen said residues and then rinsing said surface to remove said loosened residue.

20. The method of claim 19 wherein the pH of the composition is 9.

21. A method for treating hard surfaces soiled with coated-on, baked-on or dried-on food residues comprising:

applying to such soiled surface a pre-spotting composition which comprises a. from about 3 to 20% of a surfactant selected from the group consisting of anionic surfactants, nonionic surfactants and mixtures thereof;

b. from about 2 to 7% of a builder selected from the group consisting of polyphosphates, citrates, pyrophosphates, carbonates and mixtures thereof;

c. from about 0.5 to 2% of an amine selected from the group consisting of monoethanolamine, diethanolamine, and triethanolamine and mixtures thereof;

d. from about 3 to 20% of a solvent, which solvent is selected from the groups consisting of diethylene glycol monobutyl ether, ethylene glycol monobutyl ether, and N-methyl 2-pyrrolidone and mixtures thereof;

e. from about 3 to 22% imidazole; and f. water;

and maintaining said so applied soiled surface at a temperature ranging from room temperature to 45° C. for a period of time ranging from at least about ten to thirty minutes to permit said composition to loosen said residues and then rinsing said surface to remove said loosened residue.

22. The method of claim 21 wherein the pH of said composition is 10.

* * * * *